US009561429B2

(12) United States Patent
Gomez et al.

(10) Patent No.: US 9,561,429 B2
(45) Date of Patent: Feb. 7, 2017

(54) ELECTROMAGNET FOR AN AMUSEMENT GAME DEVICE

(71) Applicant: Stern Pinball, Inc., Melrose Park, IL (US)

(72) Inventors: George A. Gomez, Chicago, IL (US); Michael Redoble, Chicago, IL (US); John M. Rotharmel, Palatine, IL (US)

(73) Assignee: Stern Pinball, Inc., Melrose Park, IL (US)

( * ) Notice: Subject to any disclaimer, the term of this patent is extended or adjusted under 35 U.S.C. 154(b) by 71 days.

(21) Appl. No.: 14/528,552

(22) Filed: Oct. 30, 2014

(65) Prior Publication Data

US 2016/0121203 A1 May 5, 2016

(51) Int. Cl.
*A63F 7/02* (2006.01)
*A63F 7/30* (2006.01)

(52) U.S. Cl.
CPC ..... *A63F 7/027* (2013.01); *A63F 7/3075* (2013.01)

(58) Field of Classification Search
CPC ..... A63F 7/025
USPC ..... 273/121 R, 180, 121 A, 239, 126 A, 121 B,273/118 A, 127 R, 119 A
See application file for complete search history.

(56) References Cited

U.S. PATENT DOCUMENTS 4,065,129 A * 12/1977 Bartok ..... A63F 7/3065 124/10
4,373,725 A 2/1983 Ritchie
5,351,954 A 10/1994 Ousler et al.
5,356,142 A 10/1994 Borg et al.
5,415,403 A 5/1995 Ritchie
5,673,913 A * 10/1997 Toler ..... A63F 7/027 273/118 A
6,669,195 B1 * 12/2003 Gordon ..... A63F 7/022 273/121 B
2014/0182088 A1 * 7/2014 Roberts ..... B42F 1/00 24/303

OTHER PUBLICATIONS

ISA/US, International Search Report and Written Opinion issued on PCT application No. US15/58377, dated Feb. 4, 2016, 7 pages.

* cited by examiner

*Primary Examiner* — Gene Kim
*Assistant Examiner* — Rayshun Peng
(74) *Attorney, Agent, or Firm* — Greenberg Traurig, LLP

(57) ABSTRACT

A front cabinet panel piece, a back panel cabinet piece, a first side cabinet panel piece, and second side cabinet panel piece, each having a plurality of pre-formed openings, are arranged relative to one another to form an amusement game cabinet. The plurality of pre-formed openings are used to accept a corresponding plurality of knock-down hardware pieces each including a fastener locking component and a fastener. The fastener locking components are held within respective first ones of the pre-formed openings and the fastener is inserted into second ones of the pre-formed openings that are aligned with the first ones of the plurality of pre-formed openings. Each fastener is mated to its corresponding fastener locking component to complete assembly of the amusement game cabinet. The assembled amusement game cabinet is used to support a playfield and the playfield, in turn, is used to provide additional structural support to the amusement game cabinet.

14 Claims, 5 Drawing Sheets

ELECTROMAGNET FOR AN AMUSEMENT GAME DEVICE

BACKGROUND

Electromagnets for use in connection with a playfield of an amusement game device, such as a pinball machine, a redemption game, etc., of the commercial type, e.g., revenue generating, and the non-commercial type, e.g., home entertainment, are known in the art. By way of example, U.S. Pat. No. 4,373,725 and U.S. Pat. No. 5,673,913 (incorporated herein by reference in their entirety) illustrate and describe a pinball game in which an electromagnet is positioned on or below the playfield. A computer-controlled circuit is coupled to the electromagnet and, under control of the computer-controlled circuit, the electromagnet is operable to control a ball moving upon the playfield, e.g., to alter trajectories of the ball, to capture and hold the ball, and/or to impart random motion to the ball.

When an electromagnet is to be positioned on the playfield, an iron alloy magnet core that protrudes thru the surface of the wood playfield board is typically utilized. As will be appreciated, the exposed magnet core provides the most powerful application of the device because the energized magnet core can come in direct contact with the steel pinball. In such an application, it is also important that the magnet core be installed flush to the surface of the playfield board to prevent the ball from skipping when it encounters the edge of the magnet core and that the diameter of the magnet core be optimized around the dimensional parameters of the steel pinball as a magnet core that is either too small or too large adversely affects the magnetic flux density making it difficult to grab the moving pinball as it passes at speed over the magnetic core, to hold the pinball on the magnetic core, and/or to move or oscillate the pinball via use of the magnet core under software control.

Given the effective diameter of the core, as the pinball is caught by the energized magnet core, the ball oscillates across the surface of the magnet core. During this motion it is common for the ball to cross back and forth across the perimeter edge of the magnet core and the associated edge of the hole in the wood playfield board. This motion undesirably tends to erode and wear the edge of the wood at the edge of the playfield board thru which the magnet core protrudes.

SUMMARY

The following describes an improved electromagnet for use in connection with a playfield of an amusement game. Generally, the electromagnet assembly includes a magnet core constructed from a ferromagnetic material, a protector element constructed from a non-ferromagnetic material which is attached to a first end of the magnet core, and a magnet connector assembly disposable around the magnet core for activating the magnet core under control of a processing device of the amusement game. The protector element surrounds the magnet core and is arranged relative to the magnet core such that a surface of the protector element which is to be exposed on the first surface of the playfield is flush to a surface of the magnet core which is also to be exposed on the first surface of the playfield. The desired protector element is sized to define an area on the first surface of the playfield that is larger than an area on the first surface of the playfield in which the object may move when the magnet core is activated for the purpose of capturing the object upon the first surface of the playfield.

A better understanding of the objects, advantages, features, properties and relationships of the subject electromagnet will be obtained from the following detailed description and accompanying drawings which set forth illustrative embodiments which are indicative of the various ways in which the principles of the electromagnet assembly may be employed.

BRIEF DESCRIPTION OF THE DRAWINGS

For a better understanding of the electromagnet assembly described hereinafter reference may be had to the following drawings in which.

DETAILED DESCRIPTION

With reference to the figures, an amusement game device, in the exemplary form of a pinball machine 10 is now described. It is to be appreciated, however, that this exemplary form for the amusement game device 10 is not intended to be limiting. Rather, those of ordinary skill in the art will appreciated that the electromagnet assembly described hereinafter can be utilized in any type of amusement game device of the commercial and non-commercial type in which it is desired to control movement of an object, such as a steel pinball, on a playfield.

Figure 1:
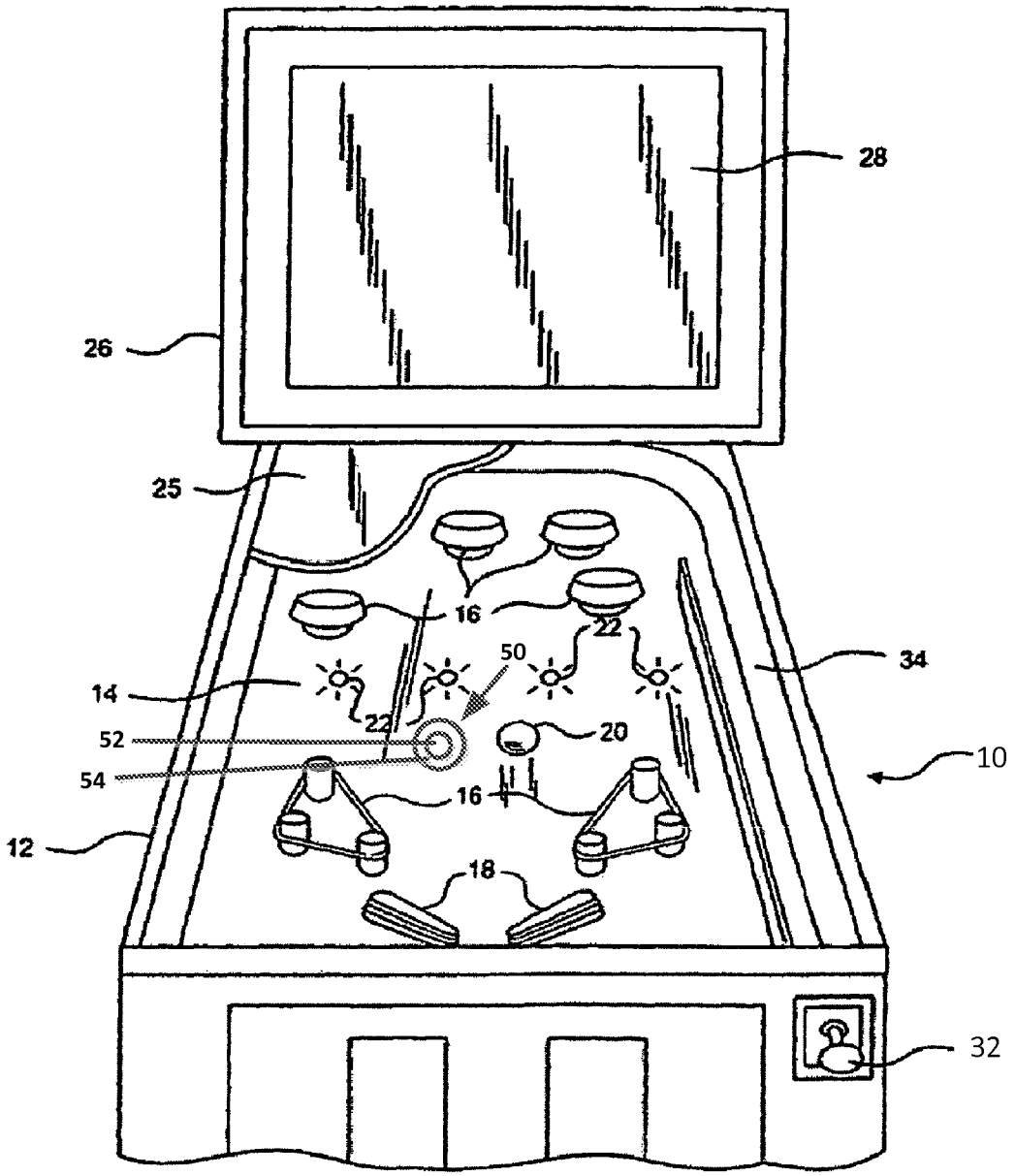
FIG. 1 illustrates an exemplary amusement game device in the form of a pinball machine.

In keeping with the example of an amusement game device 10 of the pinball machine type, the amusement game device 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. Upon activation of the game in this manner, game play, in the case of a pinball machine, is defined upon an inclined playfield 14 that supports a number of playfield accessories or devices. More particularly, in the case of a pinball machine, game play is generally defined through the use of a pair of flippers 18 to propel a ball 20 relative to the playfield 14 and input devices/accessories associated with the playfield 14. The playfield 14 is usually inclined from the horizontal such that the ball tends to eventually roll back down the playfield 14 in the direction of the flippers 18. While not intended to be limiting, the playfield accessories 16 may include elements such as bumpers, ramps, and/or targets as well as the subject electromagnet assembly 50. The playfield 14 may be covered by a transparent or glass sheet cover 25 to permit viewing of the playfield 14. In addition to the foregoing, the playfield 14 includes a plunger element 32 which shoots the ball 20 up an alley 34 onto the playfield 14. The playfield 14 may also include lighting elements 22 and/or other features as desired.

Other player-activated input elements, typically in the form of push-buttons on the sides of the cabinet 12, are usually provided for controlling operation of the flippers 18. Push-buttons may also be used to control operation of the electromagnet assembly 50 if desired. The amusement game 10 may also include a backbox 26 which is mounted to overlay a top rear portion of the cabinet 12 and which contains a game display 28, such as a dot matrix display, CRT, LED or plasma display, or the like. The backbox 26 may also support speakers associated with the game sound system. Within the backbox 26 may be located various ones of the electronic devices/circuits for controlling the operation of the playfield devices, the display, general illumination, and the sound system. Such electronic devices/circuits could also, in whole or in part, be carried within the game cabinet 12. It is to be understood that the electromagnet assembly 50 can be installed at any one or more desired locations on a playfield and, as such, is not to be limited to the exemplary location shown in FIG. 1.

Figure 2:
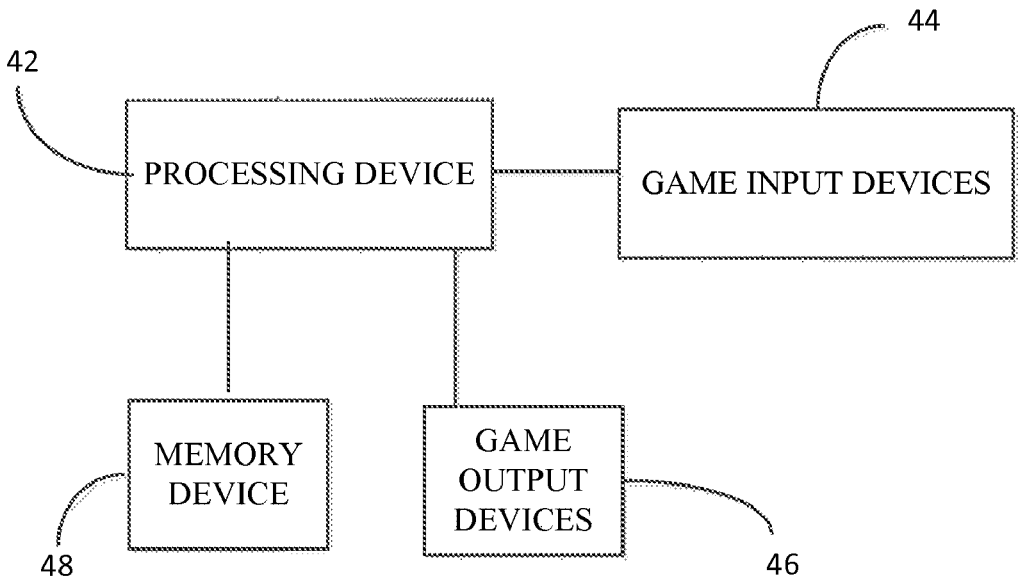
FIG. 2 is an exemplary block diagram of exemplary components of the amusement game device of FIG. 1.

For controlling the various devices that form the amusement game 10, the amusement game 10 is provided with a processing device 42 which processing device 42 is, in turn, coupled to game input devices 44, such as switches associated with the cabinet 12, playfield 14, etc., and game output devices 46, such as lights, flippers 18, display 28, electromagnet assembly 50, etc. via one or more bus systems as shown in FIG. 2. A memory device 48, such as a RAM, ROM, or the like, stores instructions and data usable by the processing device 42 to control play of the game, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3:
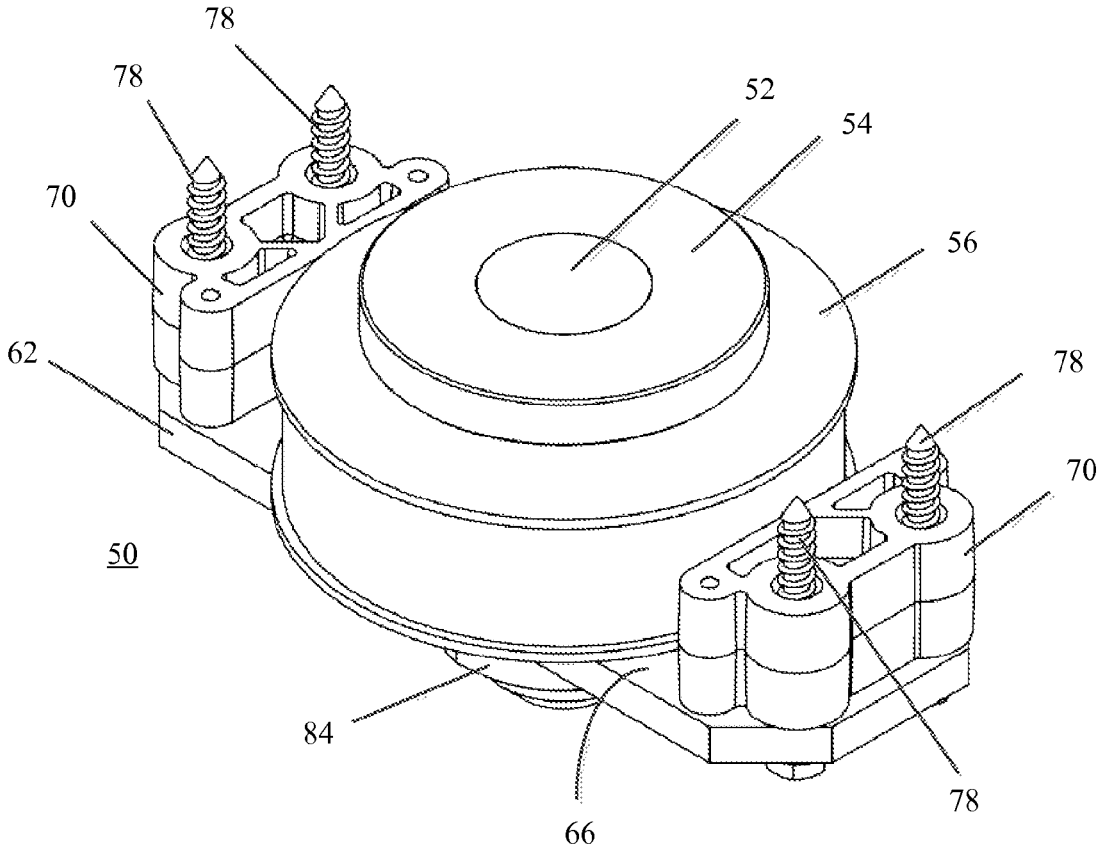
FIG. 3 is an isometric view of an exemplary electromagnet assembly for use with the amusement game device of FIG. 1.
Figure 4:
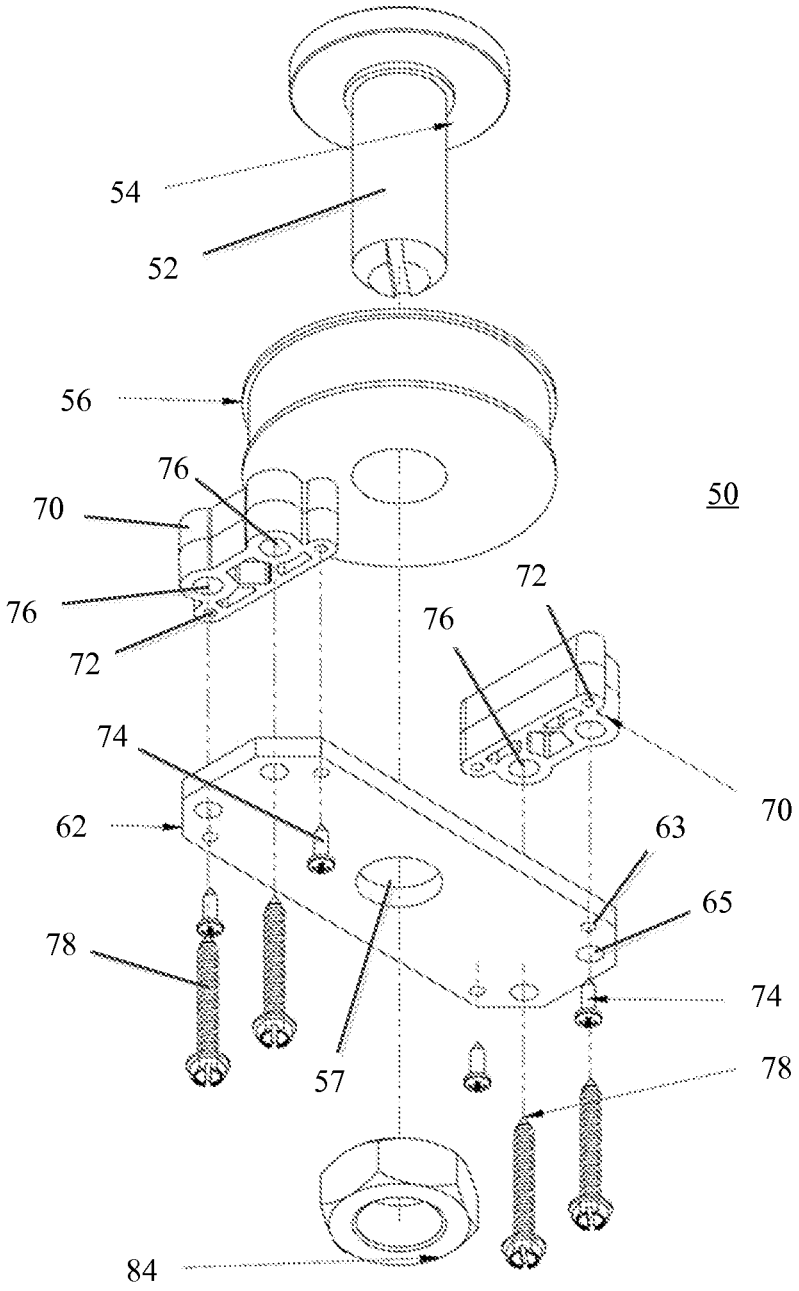
FIG. 4 is an exploded view of the exemplary electromagnet assembly of FIG. 3.
Figure 5:
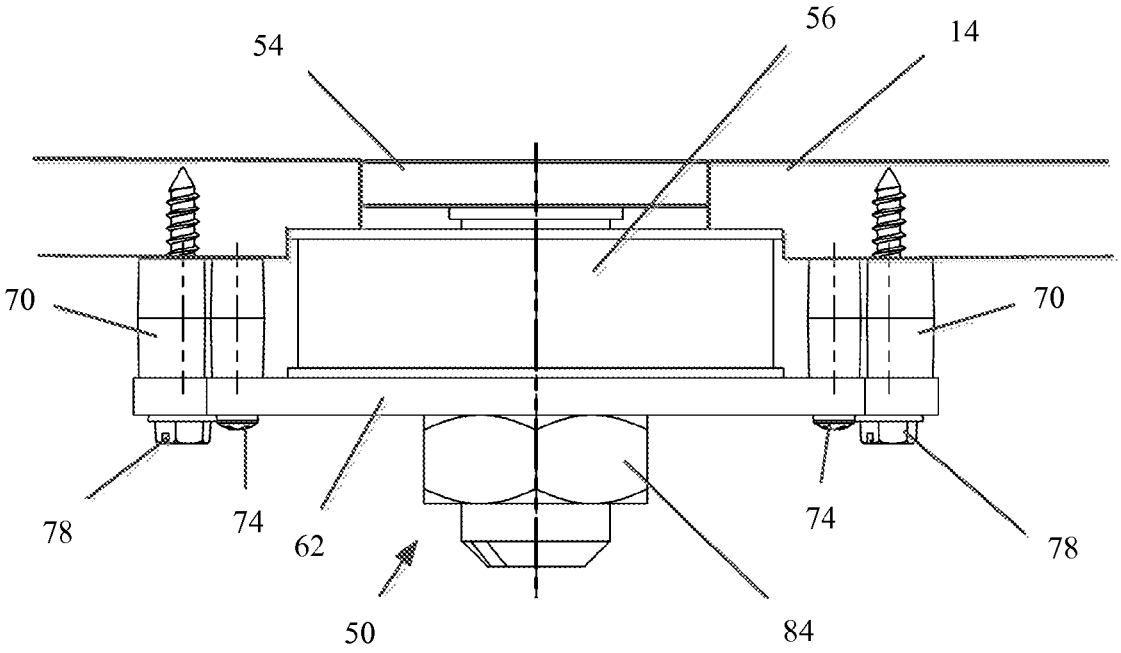
FIG. 5 is a side view of the exemplary electromagnet assembly of FIG. 3 attached to a playfield of the amusement game device of FIG. 1.

Turning now to FIGS. 3-5, an exemplary electromagnet assembly 50 for use in connection with a playfield 14 is described. Generally, the electromagnet assembly 50 includes a magnet core 52, formed from a ferromagnetic material such as iron, a protector element 54, formed from a generally non-ferromagnetic material such as stainless steel, a magnet connector assembly 56, and structure for mounting the magnet core 52, protector element 54, and magnet connector assembly 56 to a playfield 14.

The magnet connector assembly 56 comprises a housing constructed from a non-conducting material in which windings of wire are carried. The magnet connector assembly includes an opening 57 into which the magnet core 52 is inserted such that the windings of wire will encircle the magnet core 52. In operation, the processing device 42 is used to control the amount of electric current that is provided to the windings of wire of the magnet connector assembly 56 to thereby control the magnetic field that is caused to be generated by the magnet connector assembly 56 and the magnet core 52 that is disposed therein.

The protector element 54 is attached to a first end of the magnet core 52. To this end, the protector element 54 preferably includes an opening into which the magnet core 52 is inserted such that the protector element 54 will encircle the first end of the magnet core 52. When the magnet core 52 and the protector element 54 are attached to each other, the top surface of the protector element 54 and the top surface of the magnet core 52 are intended to be flush whereby, when the magnet core 52 and protector element 54 are mounted so as to be flush with the top surface of the playfield 14, the combined elements will provide a smooth surface across which the playfield object may travel. The proctor element 54 may be attached to the magnet core 52 by use of an adhesive, by being friction fit thereto, by use of mechanical means (such as screw threads), and/or by using any other well-known technique without limitation.

For mounting the combined magnet core 52, protector element 54, and magnet connector assembly 56 to the bottom surface of the playfield 14, the mounting assembly includes a magnet mounting plate 62. The magnet mounting plate 62 has an opening 64 into which the magnet core 52 is received and a top surface 66 upon which magnet connector assembly 56 is to be positioned. A locking element 84 is additionally provided for use in coupling with a second end of the magnet core 52 that is opposite to the first end of the magnet core 52 to which the protector element 54 is attached. The locking element 84 is to be attached to the second end of the magnet core 52, by being friction fit thereto, by use of mechanical means (such as screw threads), and/or by using any other well-known technique without limitation, to thereby ensure that the magnet connector assembly 56 is secured between the magnet mounting plate 62 and the bottom side surface of the protector element 54.

For use in attaching the above-noted elements to the playfield 14, the mounting assembly may further include a pair of mounting blocks 70. The illustrated mounting blocks 70 each have a first set of fastener receiving openings 72 for receiving fasteners 74 which are used to attach the mounting blocks 70 to opposed ends of the top surface 66 of the magnet mounting plate 62 via openings 63 provided to the magnet mounting plate 62. As further illustrated, the mounting blocks 70 each have a second set of fastener receiving openings 76 for receiving fasteners 78, via openings 65 provided in the magnet mounting plate 62, which are used to attach the entire assembly to the underside of the playfield 14 with the top surfaces of the magnet core 52 and protector element 54 being located within an opening in the playfield 14 and flush with the top surface of the playfield 14 as particularly illustrated in FIG. 5.

From the foregoing, it will be appreciated that the described electromagnet assembly 50 provides various advantages over the prior art. For example, the described electromagnet assembly 50 applies a larger diameter, generally non-magnetic collar, which is concentric to and flush with the electromagnetic core that is exposed on the playfield surface, to preserve the optimal magnetic flux density of the magnet core and to provide a tough hard surface for the ball to move on. In this regard, the diameter of the stainless steel collar is preferably selected to be larger than the range of motion of the ball while the ball is under the influence of the energized electromagnet to eliminate all wear to the wood playfield board around the electromagnet assembly. The described electromagnet assembly also uses precision machined components and molded components to assure that the magnet core and collar are able to be adjustably positioned parallel to, i.e., flush with, the surface of the wood playfield board for the benefits described herein.

While a specific embodiment of the invention has been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. An electromagnet assembly for use in connection with an amusement game having a playfield and an object which moves across a first surface of the playfield, comprising:

a magnet core constructed from a ferromagnetic material;

a protector element constructed from a non-ferromagnetic material attached to a first end of the magnet core, the protector element encircling the magnet core and arranged relative to the magnet core such that a first planar surface of the protector element which is to be exposed on the first surface of the playfield is flush to a planar surface of the magnet core which is also to be exposed on the first surface of the playfield; and a magnet connector assembly disposable around the magnet core for activating the magnet core under control of a processing device of the amusement game;

wherein the protector element is sized to define an area on the first surface of the playfield that is larger than an area on the first surface of the playfield in which the object may oscillate when the magnet core is activated for the purpose of capturing the object upon the first surface of the playfield.

2. The electromagnet assembly as recited in claim 1, wherein the protector element is constructed from stainless steel.

3. The electromagnet assembly as recited in claim 1, further comprising a magnet mounting plate for carrying each of the magnet core and the magnet connector assembly and for attaching the magnet core and the magnet connector assembly to a second surface of the playfield opposite to the first surface of the playfield.

4. The electromagnet assembly as recited in claim 3, wherein the magnet mounting plate has an opening in which is positioned the magnet core.

5. The electromagnet assembly as recited in claim 4, wherein the magnet mounting plate has a first surface upon which the magnet connector assembly is disposed.

6. The electromagnet assembly as recited in claim 5, further comprising a locking element attachable to a second end of the magnet core adjacent to a second surface of the magnet mounting plate for securing the magnet connector assembly between the first surface of the magnet mounting plate and a second surface of the protector element and wherein the second surface of the protector element is opposite to the first surface of the protector element and the second surface of the magnet mounting plate is opposite to the first surface of the magnet mounting plate.

7. The electromagnet assembly as recited in claim 6, further comprising at least a pair of mounting blocks attachable to the first surface of the magnet mounting plate, the mounting blocks each accepting at least one fastener for allowing the magnet mounting plate to be attached and adjustably positioned relative to the second surface of the playfield.

8. An amusement game, comprising:

a game cabinet;

a playfield mounted within the game cabinet;

a processing device;

an object which moves across a first surface of the playfield; and an electromagnet assembly coupled to the processing device and associated with the playfield, the electromagnet assembly comprising:

a magnet core constructed from a ferromagnetic material;

a protector element constructed from a non-ferromagnetic material attached to a first end of the magnet core, the protector element encircling the magnet core and arranged relative to the magnet core such that a first planar surface of the protector element which is exposed on the first surface of the playfield is flush to a planar surface of the magnet core which is also exposed on the first surface of the playfield; and a magnet connector assembly disposed around the magnet core for activating the magnet core under control of the processing device of the amusement game;

wherein the protector element is sized to define an area on the first surface of the playfield that is larger than an area on the first surface of the playfield in which the object may oscillate when the magnet core is activated for the purpose of capturing the object upon the first surface of the playfield.

9. The amusement game as recited in claim 8, wherein the protector element is constructed from stainless steel.

10. The amusement game as recited in claim 8, wherein the electromagnet assembly further comprises a magnet mounting plate for carrying each of the magnet core and the magnet connector assembly and for attaching the magnet core and the magnet connector assembly to a second surface of the playfield opposite to the first surface of the playfield.

11. The amusement game as recited in claim 10, wherein the magnet mounting plate has an opening in which is positioned the magnet core.

12. The amusement game as recited in claim 11, wherein the magnet mounting plate has a first surface upon which the magnet mounting assembly is disposed.

13. The amusement game as recited in claim 12, wherein the electromagnet assembly further comprises a locking element attachable to a second end of the magnet core adjacent to a second surface of the magnet mounting plate for securing the magnet connector assembly between the first surface of the magnet mounting plate and a second surface of the protector element and wherein the second surface of the protector element is opposite to the first surface of the protector element and the second surface of the magnet mounting plate is opposite to the first surface of the magnet mounting plate.

14. The amusement game as recited in claim 13, wherein the electromagnet assembly further comprises at least a pair of mounting blocks attachable to the first surface of the magnet mounting plate, the mounting blocks each accepting at least one fastener for allowing the magnet mounting plate to be attached and adjustably positioned relative to the second surface of the playfield.

* * * * *